US011148247B2

(12) United States Patent
Cho et al.

(10) Patent No.: US 11,148,247 B2
(45) Date of Patent: Oct. 19, 2021

(54) SUBSTRATE POLISHING SYSTEM AND SUBSTRATE POLISHING METHOD

(71) Applicant: Samsung Display Co., Ltd., Yongin-si (KR)

(72) Inventors: Hyun Jin Cho, Seoul (KR); Joon-Hwa Bae, Suwon-si (KR); Byoung Kwon Choo, Hwaseong-si (KR); Byung Hoon Kang, Hwaseong-si (KR); Jun Hyuk Cheon, Seoul (KR); Jeong-Hye Choi, Hwaseong-si (KR); Young Ho Jeong, Osan-si (KR); Woo Jin Cho, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 502 days.

(21) Appl. No.: 15/664,166

(22) Filed: Jul. 31, 2017

(65) Prior Publication Data

US 2018/0043501 A1 Feb. 15, 2018

(30) Foreign Application Priority Data

Aug. 12, 2016 (KR) ..... 10-2016-0103305

(51) Int. Cl.
*B24B 37/34* (2012.01)
*B24B 53/017* (2012.01)
*B24B 37/10* (2012.01)

(52) U.S. Cl.
CPC ..... *B24B 37/345* (2013.01); *B24B 37/10* (2013.01); *B24B 53/017* (2013.01)

(58) Field of Classification Search
CPC ..... B24B 37/345; B24B 37/10; B24B 37/017; H01L 21/67703; H01L 21/67706;
(Continued)

(56) References Cited

U.S. PATENT DOCUMENTS 5,544,546 A * 8/1996 Dopke ..... B41F 21/05 74/54
6,039,635 A * 3/2000 Mitsuhashi ..... B24B 53/017 451/288

(Continued)

FOREIGN PATENT DOCUMENTS

CN 1237783 A 12/1999
CN 1603897 A 4/2005

(Continued)

OTHER PUBLICATIONS

Kim Young Sang, Machine Generated English Translation of the claims of KR 20090055660. Published Jun. 3, 2009. (Year: 2009).*

(Continued)

*Primary Examiner* — Sylvia MacArthur
(74) *Attorney, Agent, or Firm* — Cantor Colburn LLP

(57) ABSTRACT

A substrate polishing system includes: a polishing machine and a substrate transporter. The polishing machine includes: a lower surface plate to which a substrate is mounted, and an upper surface plate which faces the lower surface plate and polishes the substrate in cooperation with the lower surface plate, the upper surface plate having a larger area than the substrate mounted on the lower surface plate. The substrate transporter is adjacent to the polishing machine and commonly transports the substrate to and from the polishing machine in a first direction, attaches the substrate to the lower surface plate before polishing thereof, and separates from the lower surface plate the substrate after polishing thereof.

10 Claims, 14 Drawing Sheets

(58) Field of Classification Search
CPC ..... H01L 21/67715; H01L 21/67733; H01L 21/67736; H01L 21/683; H01L 21/68; H01L 21/67346; H01L 21/67748; H01L 21/6835; H01L 21/687; H01L 21/68721
USPC ..... 156/12, 31, 32; 345/12, 31, 32
See application file for complete search history.

(56) References Cited

U.S. PATENT DOCUMENTS

| | | | | |
|---|---|---|---|---|
| 6,139,409 | A | 10/2000 | Inaba | |
| 6,263,590 | B1 * | 7/2001 | Whigham | C23C 16/4401 34/426 |
| 6,488,565 | B1 * | 12/2002 | White | B24B 27/0076 451/285 |
| 6,569,282 | B1 * | 5/2003 | Arisa | H01L 21/6708 156/345.21 |
| 6,863,590 | B2 * | 3/2005 | Kobayashi | B24B 37/345 451/287 |
| 7,364,616 | B2 | 4/2008 | Tsuchiya et al. | |
| 8,545,159 | B2 | 10/2013 | Hwang et al. | |
| 9,138,857 | B2 * | 9/2015 | Lu | B24B 37/04 |
| 2003/0051812 | A1 * | 3/2003 | Sotozaki | H01L 21/67046 156/345.12 |
| 2006/0211181 | A1 | 9/2006 | Chung | |
| 2006/0286769 | A1 * | 12/2006 | Tsuchiya | H01L 21/6838 438/458 |
| 2007/0000874 | A1 * | 1/2007 | Watanabe | B24B 37/30 216/88 |
| 2007/0298692 | A1 * | 12/2007 | Mavliev | B24B 53/017 451/56 |
| 2008/0089768 | A1 * | 4/2008 | Sakamoto | B25J 9/023 414/627 |
| 2008/0182392 | A1 | 7/2008 | Yeh et al. | |
| 2010/0099340 | A1 * | 4/2010 | Chen | B24B 37/16 451/287 |
| 2018/0043501 | A1 * | 2/2018 | Cho | B24B 37/10 |

FOREIGN PATENT DOCUMENTS

| | | | |
|---|---|---|---|
| CN | 1695241 | A | 11/2005 |
| CN | 203887686 | U | 10/2014 |
| CN | 205043601 | U | 2/2016 |
| KR | 20090055660 | A * | 6/2009 |
| KR | 1020090055660 | A | 6/2009 |

OTHER PUBLICATIONS

Kim Young Sang, Machine Generated English Translation of the description of KR 20090055660. Published Jun. 3, 2009. (Year: 2009).*
Kim Young Sang, Machine Generated English Translation of the abstractor KR 20090055660. Published Jun. 3, 2009. (Year: 2009).*
Chinese Office Action for Chinese Patent Application No. 201710691541.7 dated May 6, 2021.

* cited by examiner

SUBSTRATE POLISHING SYSTEM AND SUBSTRATE POLISHING METHOD

This application claims priority to Korean Patent Application No. 10-2016-0103305 filed on Aug. 12, 2016, and all the benefits accruing therefrom under 35 U.S.C. § 119, the content of which in its entirety is incorporated herein by reference.

BACKGROUND

1. Field

The present disclosure relates to a substrate polishing system and a method for polishing a substrate using the substrate polishing system.

2. Description of the Related Art

Amorphous silicon used in an active layer of a transistor for a display device has relatively low mobility of an electron as a charge carrier. However, a transistor of a display device having an active layer including or made of polycrystalline silicon may more easily realize a driving circuit on a substrate, as compared to a thin film transistor ("TFT") which is manufactured with amorphous silicon.

SUMMARY

An exemplary embodiment provides a substrate polishing system and a substrate polishing method using the same, for relative ease in polishing a protrusion of an object to be processed.

One exemplary embodiment provides a substrate polishing system including: a polishing machine and a substrate transporter. The polishing machine includes: a lower surface plate to which a substrate is mounted, and an upper surface plate which faces the lower surface plate and polishes the substrate in cooperation with the lower surface plate, the upper surface plate having a larger area than the substrate mounted on the lower surface plate. The substrate transporter is adjacent to the polishing machine and commonly transports the substrate to and from the polishing machine in a first direction, attaches the substrate to the lower surface plate before polishing thereof, and separates from the lower surface plate the substrate after polishing thereof.

The substrate polishing system may further include a conveyor which is adjacent to the polishing machine in the first direction and transports the substrate to and from the substrate transporter in a second direction crossing the first direction. The substrate transporter may commonly overlap the conveyor and the polishing machine in the first direction.

The polishing machine may further include: a polishing box forming a polishing space in which the lower surface plate is positioned; a nozzle which supplies a slurry to the polishing space; and a slurry tank connected to the nozzle.

The substrate transporter device may include: a support frame which commonly overlaps the conveyor and the polishing machine in the first direction and encloses an upper space positioned above the conveyor and the polishing box; a moving frame which is connected to the support frame, movable between the conveyor and the polishing box in the first direction, and movable between the upper space and the polishing space in a third direction crossing the first and second directions; a moving connector which connects the moving frame to the support frame, the moving connector being movable along the support frame in the first direction, and movable relative to the support frame in the third direction; and a substrate holder which is connected to the moving frame and with which the substrate is fixed to and released from the substrate transporter.

The support frame may include: a first sub-frame extending from the conveyor to the polishing machine in the first direction, at a first side of the polishing box; and a second sub-frame separated from the first sub-frame in the second direction and extending from the conveyor to the polishing machine in the first direction, at a second side of the polishing box opposite to the first side thereof in the second direction. The sub-frame and the second sub-frame may each include a guide rail along which the moving connector is movable in the first direction.

The moving connector may include: a first portion which is movable along the support frame in the first direction; and a second portion which is connected to the first portion and movable relative to the support frame in the third direction.

The substrate transporter may further commonly spray a fluid and include: a first sprayer which is connected to the moving frame and disposed adjacent to the substrate holder, is movable in the second direction relative to the moving frame and through which the fluid is sprayable; and a second sprayer which is connected to the support frame and disposed adjacent to the lower surface plate in the polishing space, is movable in the second direction relative to the support frame and through which the fluid is sprayable.

The support frame may include a third sub-frame extending in the second direction to cross the polishing space, and the second sprayer may be connected to the third sub-frame and movable in the second direction relative to the third sub-frame.

The substrate transporter may further include: a sponge which is connected to the moving frame and disposed adjacent to the substrate holder, and is movable in the second direction and the third direction relative to the moving frame; and a washing box positioned under the sponge connected to the moving frame.

The substrate transporter may further include a wiper which is connected to the moving frame and disposed adjacent to the substrate holder, and is movable in the third direction relative to the moving frame.

A method for polishing a substrate includes: transporting an unpolished substrate from a conveyor to a lower surface plate of a polishing machine, by a substrate transporter; attaching the unpolished substrate transported from the conveyor to the lower surface plate of the polishing machine, by the substrate transporter which transported the unpolished substrate from the conveyor and to the lower surface plate; polishing the unpolished substrate attached to the lower surface plate, by using the polishing machine to form a polished substrate; separating the polished substrate polished using the polishing machine from the lower surface plate of the polishing machine, by the substrate transporter which transported and attached the unpolished substrate; transporting the polished substrate from the polishing machine to the conveyor, by the substrate transporter which separated the polished substrate from the lower surface plate; and cleaning the lower surface plate of the polishing machine, by the substrate transporter which transported the polished substrate from the polishing machine.

The transporting the unpolished substrate to the lower surface plate of the polishing machine may include attaching the unpolished substrate to a substrate holder of the substrate transporter.

The attaching the unpolished substrate to the lower surface plate of the polishing machine may include pressing the unpolished substrate to the lower surface plate by a sponge of the substrate transporter which transported the unpolished substrate from the conveyor and to the lower surface plate.

The method may further include cleaning the sponge of the substrate transporter which transported the unpolished substrate from the conveyor and to the lower surface plate, by using a washing box positioned under the sponge.

The polishing the unpolished substrate attached to the lower surface plate may include disposing an upper surface plate facing the lower surface plate and which, in cooperation with the lower surface plate, polishes the polished substrate, the upper surface plate having a larger area than the unpolished substrate.

The separating the polished substrate from the lower surface plate may include spraying a fluid to an interface between the polished substrate and the lower surface plate attached to each other, by first and second sprayers of the substrate transporter which transported and attached the unpolished substrate.

The transporting the polished substrate from the polishing machine to the conveyor may include attaching the polished substrate to a substrate holder of the substrate transporter which separated the polished substrate from the lower surface plate.

The cleaning the lower surface plate of the polishing machine may include wiping a surface of the lower surface plate, by using a wiper of the substrate transporter which transported the polished substrate from the polishing machine.

According to one or more exemplary embodiment, the substrate polishing system using a same substrate transporting device at which the substrate holder, the sponge, the first and second sprayers, and the wiper are disposed, and the substrate polishing method using such polishing system, for easily polishing the protrusion of the object to be processed, are provided.

BRIEF DESCRIPTION OF THE DRAWINGS

The above and other advantages and features of this disclosure will become more apparent by describing in further detail exemplary embodiments thereof with reference to the accompanying drawings, in which.

DETAILED DESCRIPTION

Figure 1:
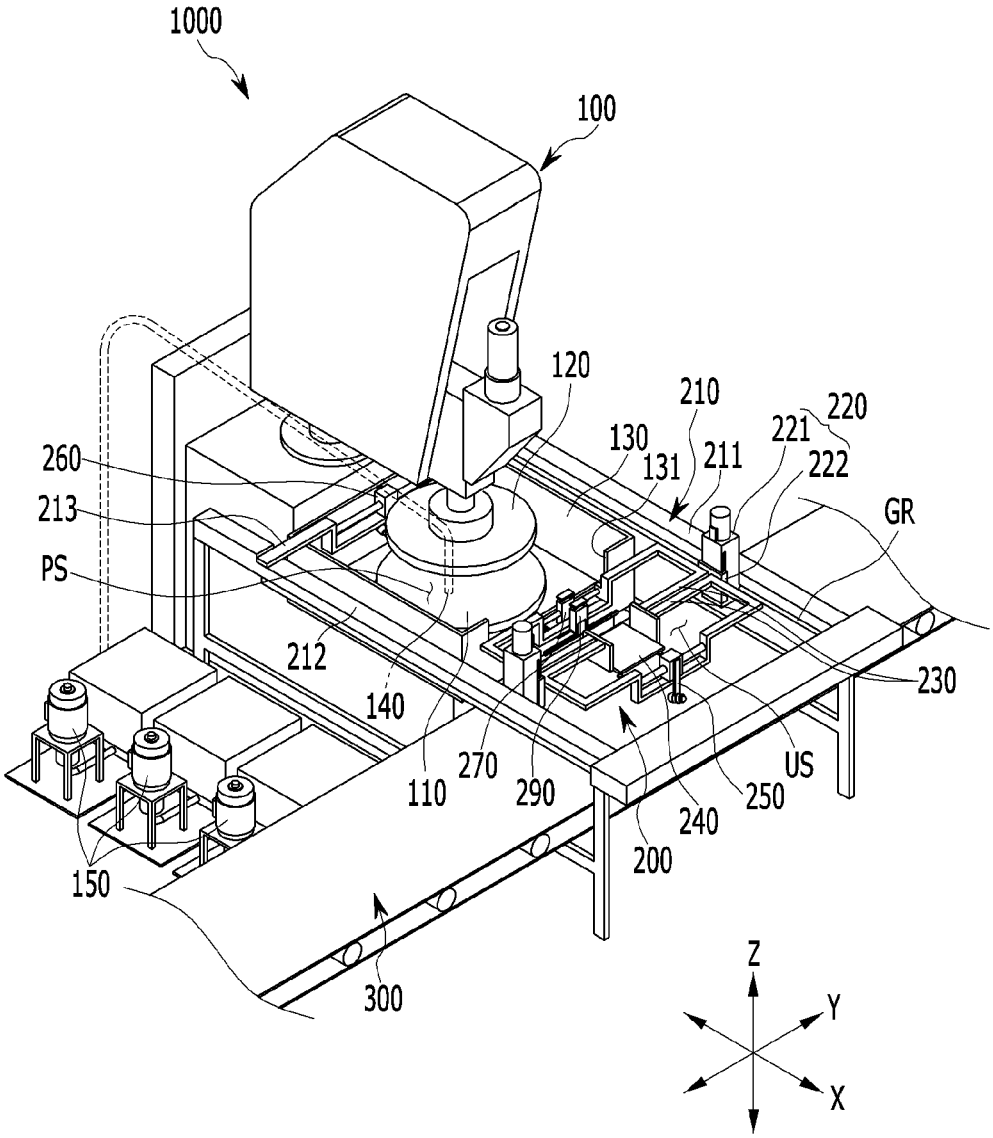
FIG. 1 is a perspective view of an exemplary embodiment of a substrate polishing system according to the invention.

The invention will be described more fully hereinafter with reference to the accompanying drawings, in which exemplary embodiments of the invention are shown. As those skilled in the art would realize, the described embodiments may be modified in various different ways, all without departing from the spirit or scope of the invention.

In order to clearly describe the invention, portions that are not connected with the description will be omitted. Like reference numerals designate like elements throughout the specification.

It will be understood that when an element such as a layer, film, region, or substrate is referred to as being "on" another element, it can be directly on the other element or intervening elements may also be present. In contrast, when an element is referred to as being "directly on" another element, there are no intervening elements present. As used herein, when an element is referred to as being "connected" to another element, the connection may be a physical, electrical and/or fluid connection.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Further, in the specification, the word "on" or "above" means positioned on or below the object portion, and does not necessarily mean positioned on the upper side of the object portion based on a gravitational direction. Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. In addition, unless explicitly described to the contrary, the word "comprise" and variations such as "comprises" or "comprising" will be understood to imply the inclusion of stated elements but not the exclusion of any other elements.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

A method of manufacturing a polycrystalline silicon thin film transistor at a relatively low temperature includes a solid phase crystallization ("SPC") method, a metal induced crystallization ("MIC") method, a metal induced lateral crystallization ("MILC") method, and an excimer laser annealing ("ELA") method. Particularly, in a manufacturing process for a transistor of an organic light emitting diode display ("OLED") or a liquid crystal display ("LCD"), the excimer laser annealing method which uses a relatively high energy laser beam to perform crystallization is used.

However, when a laser crystallizing apparatus adopting the excimer laser annealing ("ELA") method is used to scan a target substrate on which a transistor is formed and perform crystallization on a target thin film used in forming the transistor, an unintended protrusion is found at a grain boundary within an active layer of the transistor. The protrusion negatively affects characteristics of the active layer formed from the polycrystalline silicon layer so that manufacturing the transistor with desired characteristics may be difficult.

Accordingly, the protrusion of the polycrystalline silicon layer is polished in a separate or additional process, by polishing the substrate on which the polycrystalline silicon layer is formed such as by using a substrate polishing system and a substrate polishing method.

Exemplary embodiments of a substrate polishing system according to the invention will be described with reference to FIG. 1 to FIG. 7.

FIG. 1 is a perspective view of an exemplary embodiment of a substrate polishing system according to the invention.

Referring to FIG. 1, an exemplary embodiment of a substrate polishing system 1000 according to the invention is a system for polishing a protrusion of an object to be processed.

Here, the protrusion of the object to be processed may be a protrusion of a polycrystalline silicon layer formed on a substrate, a protrusion of an insulating layer formed on the substrate, or a protrusion of another structure of configuration formed on the substrate.

Hereinafter, as the protrusion of the object to be processed, the protrusion of the polycrystalline silicon layer formed on the substrate is described as an example. However the substrate polishing system 1000 may polish protrusions of other objects to be processed.

The substrate polishing system 1000 includes a polishing (portion) machine 100, a substrate transporting device 200 and a conveyor 300.

The polishing machine 100 as a polishing portion of the substrate polishing system 1000 polishes the substrate transferred thereto by the substrate transporting device 200 to polish the protrusion of the polycrystalline silicon layer formed on the substrate. The polishing machine 100 includes a lower surface plate 110, an upper surface plate 120, a polishing box 130, a nozzle 140, and a slurry tank 150.

The lower surface plate 110 is a part to or on which the substrate having the protrusion of the polycrystalline silicon layer formed thereon is mounted, and may be rotated with a predetermined rotational angular velocity. A cover (not shown) including an organic material may be positioned at a surface of the lower surface plate 110, and the cover may include polyurethane or the like. The surface may be an upper surface of the lower surface plate 110 on which on which the substrate having the protrusion of the polycrystalline silicon layer formed thereon is mounted.

The upper surface plate 120 is positioned on the lower surface plate 110, and has a larger planar area than the substrate having the protrusion of the polycrystalline silicon layer formed thereon mounted to the lower surface plate 110. That is, the upper surface plate 120 completely covers the substrate having the protrusion of the polycrystalline silicon layer formed thereon, in a top plan view. To completely cover the substrate having the protrusion of the polycrystalline silicon layer formed thereon, a rim (e.g., outer edge) of the upper surface plate 120 is disposed outside of the substrate in the top plan view such that the rim does not overlap the substrate. The upper surface plate 120 may rotate with a same predetermined rotational angular velocity as that of the lower surface plate 110.

A polishing pad (not shown) with which the substrate having the protrusion of the polycrystalline silicon layer formed thereon is polished, may be positioned at a surface of the upper surface plate 120. The surface may be a lower surface of the upper surface plate 120 which faces the lower surface plate 110. That is, the upper surface plate 120 may be considered as a member of the polishing machine 100 which polishes the substrate having the protrusion of the polycrystalline silicon layer formed thereon. The polishing pad may include at least one among an organic material, an inorganic material and a metal. The upper surface plate 120 may be connected to an arm that may move the upper surface plate 120 with respect to the lower surface plate 110. The upper surface plate 120 may move in a first direction X, a second direction Y and/or a third direction Z with respect to the lower surface plate 110. Here, the first direction X, the second direction Y and the third direction Z are directions crossing each other, respectively.

By completely covering the substrate having the protrusion of the polycrystalline silicon layer formed thereon by the upper surface plate 120 for polishing the substrate, when the upper surface plate 120 polishes the substrate having the protrusion of the polycrystalline silicon layer formed thereon, the occurrence of unintended defects on the surface of the substrate due to a rim of the upper surface plate 120 may be reduced or effectively prevented.

The first direction X may be perpendicular to the second direction Y, and the third direction Z may be perpendicular to the first direction X and the second direction Y.

The upper surface plate 120 is in contact with a portion of the substrate having the protrusion of the polycrystalline silicon layer formed thereon which is mounted to the lower surface plate 110, thereby polishing the substrate. The upper surface plate 120 may be in contact with the protrusion formed on the substrate. In polishing the substrate, the upper surface plate 120 may be rotated with respect to the lower surface plate 110 while being linearly moved in the first direction X and/or the second direction Y, and/or directions opposite thereto, with respect to a position of the lower surface plate 110.

In polishing the substrate, the upper surface plate 120 and the lower surface plate 110 may rotate in a same clockwise direction or counterclockwise direction. In this case, rotational angular velocities of the upper surface plate 120 and the lower surface plate 110 may be different from each other to effect the polishing of the substrate having the protrusion of the polycrystalline silicon layer formed thereon. In another exemplary embodiment, the upper surface plate 120 may rotate in a different direction from that of the lower surface plate 110 to effect the polishing of the substrate having the protrusion of the polycrystalline silicon layer formed thereon.

Before the upper surface plate 120 and/or the lower surface plate 110 are rotated or while the upper surface plate 120 and/or the lower surface plate 110 are rotated, a slurry (e.g., polishing medium) may be supplied between the substrate having the protrusion of the polycrystalline silicon layer formed thereon and the upper surface plate 120, from the nozzle 140. The slurry may include an abrasive in which relatively fine particles are uniformly dispersed for mechanical polishing, a reactant such as an acid or a base for a chemical reaction with the object to be polished, and ultrapure water for dispersing and mixing the abrasive and the reactant. The abrasive may include silica ($SiO_2$), ceria ($CeO_2$), alumina ($Al_2O_3$), zirconia ($ZrO_2$), tin oxide ($SnO_2$), manganese oxide ($MnO_2$), and the like.

That is, the polishing machine 100 is a device which performs chemical mechanical polishing of the substrate having the polycrystalline silicon layer including the protrusion formed thereon.

The polishing (container) box 130 forms a polishing space PS at which the lower surface plate 110 is positioned. The polishing box 130 may have a shape which is open in an upper direction (e.g., direction Z in FIG. 1). The chemical mechanical polishing of the substrate having the protrusion of the polycrystalline silicon layer formed thereon is performed within the polishing space PS formed by the polishing box 130. The polishing box 130 may include a bottom portion on which the lower surface plate 110 is disposed, and a sidewall portion which is extended from the bottom portion to define the open shape of the polishing box 130.

The polishing box 130 includes a gate 131. A suctioning portion 240 supported by a moving frame 230 is moved between the lower surface plate 110 and the upper surface plate 120 through the gate 131.

The nozzle 140 supplies the above-described slurry to the polishing space PS. The nozzle 140 is connected to the slurry tank 150 to supply the slurry from the slurry tank 150 to the polishing space PS.

The slurry tank 150 is connected to the nozzle 140.

Figure 2:
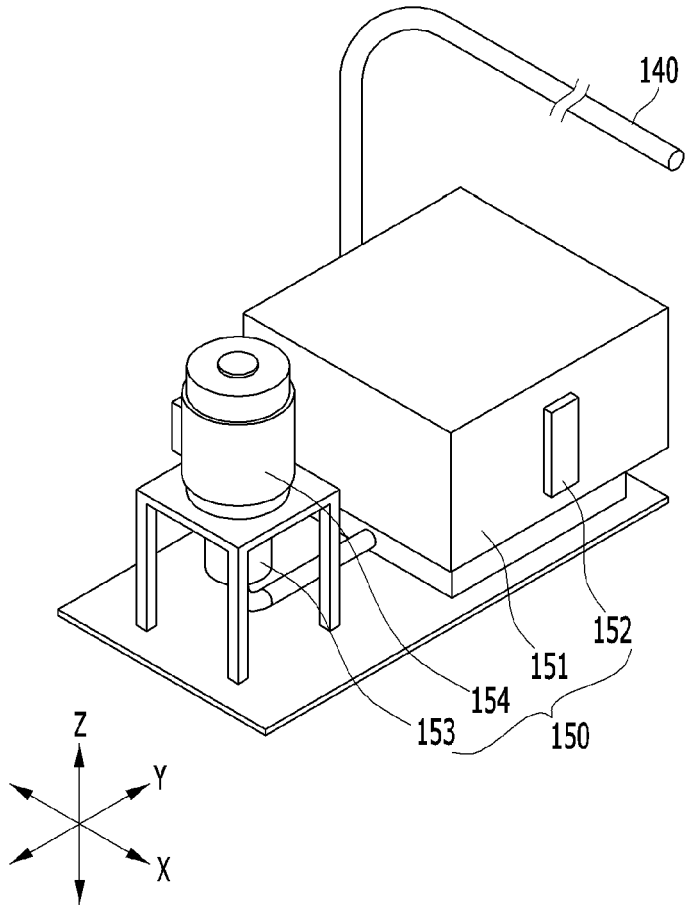
FIG. 2 is a perspective view of an exemplary embodiment of a slurry tank of the substrate polishing system shown in FIG. 1.

FIG. 2 is a perspective view of an exemplary embodiment of a slurry tank of the substrate polishing system shown in FIG. 1. Within the substrate polishing system, the slurry tank 150 may be provided in plural. Each slurry tank 150 may be connected to the nozzle 140, such that the nozzle 140 is common to each slurry tank 150

Referring to FIG. 2, the slurry tank 150 includes a tank 151, a sensor 152, a pump 153 and a flow rate controller 154.

The slurry to be transferred to the polishing space PS is stored or held inside the tank 151. The sensor 152 senses a level of the slurry stored inside the tank 151. The pump 153 pumps the slurry from the tank 151 to the nozzle 140. The flow rate controller 154 may control a flow rate of the slurry that is moved from the slurry tank 150 to the nozzle 140.

The slurry tank 150 and the tank 151 thereof may be provided in plural, and a plurality of tanks 151 may store different fluids from each other.

In an exemplary embodiment, for example, one tank 151 among the plurality of tanks 151 may include the slurry, and another tank 151 may include a surfactant that hydrophilicizes or hydrophobicizes the surface of the substrate having the protrusion of the polycrystalline silicon layer formed thereon. Here, the other tank 151 may be connected to the nozzle 140, and the surfactant is supplied to the substrate from the other tank 151 through the nozzle 140 such that the surface of the substrate may become hydrophilic or hydrophobic.

In an exemplary embodiment, for example, after polishing of the substrate having the protrusion of the polycrystalline silicon layer formed thereon by the polishing machine 100, the surfactant is supplied to the surface of the substrate such that the surface of the substrate may become hydrophilic.

Again referring to FIG. 1, the substrate transporting device 200 is adjacent to the polishing machine 100. The substrate transporting device 200 transports the substrate having the protrusion of the polycrystalline silicon layer formed thereon in the first direction X and a direction opposite thereto such that the substrate is respectively transported to and from each of the conveyor 300 and the polishing machine 100. In an exemplary embodiment, the substrate transporting device 200 transports the substrate having the protrusion of the polycrystalline silicon layer formed thereon from the conveyor 300 to the lower surface plate 110 for polishing, attaches the substrate to the lower surface plate 110 for polishing, separates the substrate from the lower surface plate 110 after the polishing, and transports the substrate from the lower surface plate 110 to the conveyor 300.

The substrate transporting device 200 includes a support frame 210, a moving unit 220, the moving frame 230, the suctioning portion 240, a first sprayer 250, a second sprayer 260, a sponge 270, a washing box 280 (referring to FIG. 6), and a wiper 290.

The support frame 210 encloses or defines an upper space US which extends to commonly overlap the conveyor 300 and the polishing box 130. The support frame 210 may enclose at least portion of the upper space US and at least portion of the polishing box 130.

The support frame 210 includes a first sub-frame 211, a second sub-frame 212 and a third sub-frame 213. The first through third sub-frames 211 to 213 may cooperate to define an opening as the upper space US.

The first sub-frame 211 is disposed at an upper part of the conveyor 300 and lengthwise extends in the first direction X to correspond to one surface of the polishing box 130. The first sub-frame 211 may face one side wall of the polishing box 130 lengthwise extended in the first direction X and in the direction opposite thereto.

The second sub-frame 212 is separated from the first sub-frame 211 in the second direction Y. The second sub-frame 212 is disposed at the upper part of the conveyor 300 and lengthwise extends in the first direction X to correspond to another surface of the polishing box 130 opposite to the one surface thereof. The second sub-frame 212 may face another side wall of the polishing box 130 opposite to the one side wall.

The first sub-frame 211 and the second sub-frame 212 support the moving unit 220 thereon. The first sub-frame 211 and the second sub-frame 212 include a guide rail or groove GR. The moving unit 220 is supported by and/or on the guide rail GR of the first sub-frame 211 and the second sub-frame 212, and the moving unit 220 may move along the guide rail GR in the first direction X.

The third sub-frame 213 crosses the polishing space PS. The third sub-frame 213 is disposed in the polishing box 130, as illustrated in FIG. 1. The third sub-frame 213 connects the first sub-frame 211 and the second sub-frame 212 to each other. The third sub-frame 213 lengthwise extends in the second direction Y. Along the second direction Y, the third sub-frame 213 is bent, such as in the third direction Z and a direction opposite thereto. A bent portion of the third sub-frame 213 may be positioned inside the polishing space PS. A second sprayer 260 of the substrate transporting device 200 is supported by and/or on the third sub-frame 213.

The moving unit 220 is supported by the support frame 210. The moving unit 220 is movable in the first direction X. The moving unit 220 is movable in the third direction Z and the direction opposite thereto, each crossing the first direction X and the second direction Y. The moving unit 220 includes a first moving unit 221 and a second moving unit 222. The moving unit 220 acting as a connector, connects the first and second moving units 221 and 222, to the support frame 210.

The first moving unit 221 is guided by the support frame 210 to be movable in the first direction X and in the direction opposite thereto. The first moving unit 221 is supported by and/or on the guide rail GR of the first sub-frame 211 of the support frame 210 and the guide rail GR of the second sub-frame 212. The first moving unit 221 is movable along the first sub-frame 211 and the second sub-frame 212 in the first direction X and the direction opposite thereto. Since the first moving unit 221 is movable in the first direction X and the direction opposite thereto, the substrate transporting device 200 is movable in the first direction X and the direction opposite thereto.

The second moving unit 222 is connected to the first moving unit 221 and is be movable in the third direction Z and the direction opposite thereto. The second moving unit 222 and the first moving unit 221 may be connected to each other by a rail, and the second moving unit 222 may be movable in the third direction Z with respect to the first moving unit 221 by the rail. Since the second moving unit 222 is movable in the third direction Z and the direction opposite thereto, the substrate transporting device 200 is movable in the third direction Z and the direction opposite thereto.

The second moving unit 222 supports the moving frame 230 thereon. Since the second moving unit 222 is connected to the first moving unit 221, the moving frame 230 supported by the second moving unit 222 may be movable in the first and third directions X and Z and the directions opposite thereto.

Figure 3:
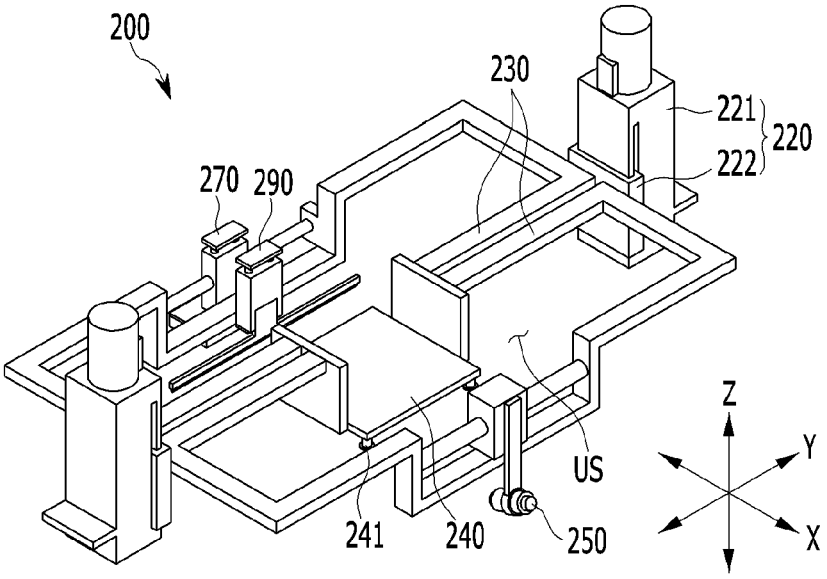
FIG. 3 is a perspective view of a portion of an exemplary embodiment of a substrate transporting device of the substrate polishing system shown in FIG. 1.

FIG. 3 is a perspective view of an exemplary embodiment a portion of a substrate transporting device of the substrate polishing system shown in FIG. 1.

Referring to FIG. 3 and FIG. 1, the moving frame 230 is supported by the second moving unit 222 of the moving unit 220, and is movable between the upper space US at the conveyor 300 and the polishing space PS at the polishing box 130, by the moving unit 220 moving in the first direction X and the third direction Z. The moving frame 230 lengthwise extends in the second direction Y along which the moving frame 230 is bent at least once. The suctioning portion 240, the first sprayer 250, the sponge 270 and the wiper 290 are supported by and/or on the moving frame 230. The moving frame 230 may have various shapes, and may have any shape as long as the moving frame 230 which is supported by the moving unit 220 supports the suctioning portion 240, the first sprayer 250, the sponge 270 and the wiper 290.

The suctioning portion 240 is supported by the moving frame 230. The suctioning portion 240 is supported by a center portion of the moving frame 230. The suctioning portion 240 applies a force to the substrate having the protrusion of the polycrystalline silicon layer formed thereon to support the substrate during transfer thereof between the conveyor 300 and the polishing machine 100. The suctioning portion 240 includes a suctioning pad 241. The suctioning pad 241 applies the force to the substrate having the protrusion of the polycrystalline silicon layer formed thereon, thereby supporting the substrate during transfer thereof. The suctioning pad 241 may be positioned corresponding to an outer region of the substrate having the protrusion of the polycrystalline silicon layer formed thereon so as to not overlap elements formed on the substrate.

Figure 4:
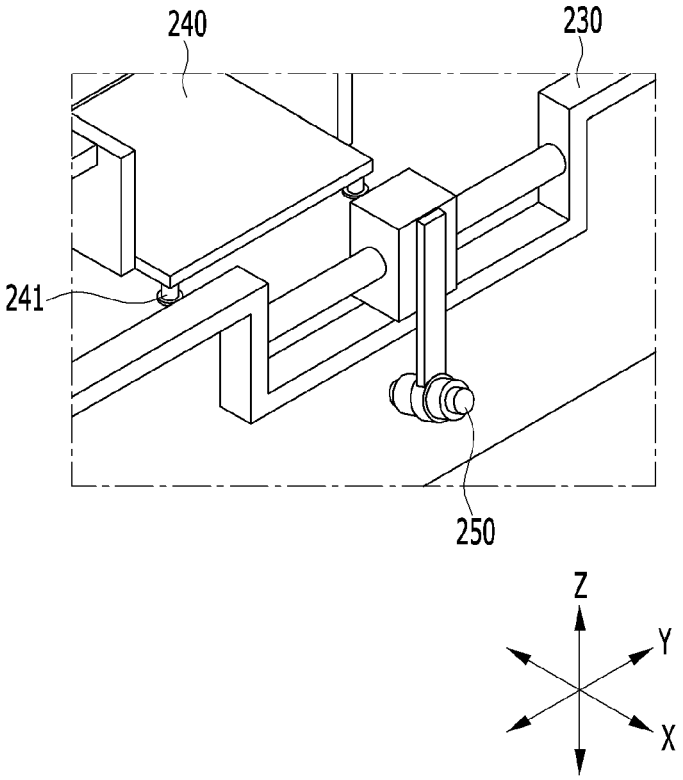
FIG. 4 is a perspective view of an exemplary embodiment of a suctioning portion and a first sprayer of the substrate transporting device shown in FIG. 3.

FIG. 4 is a perspective view of an exemplary embodiment of a suctioning portion and a first sprayer of the substrate transporting device shown in FIG. 3.

Referring to FIG. 3 and FIG. 4, the first sprayer 250 is adjacent to the suctioning portion 240 and is supported by the moving frame 230. The first sprayer 250 is supported by the moving frame 230 by a rail thereof lengthwise extending in the second direction Y. The moving frame 230 may be formed by a plurality of rails extended in various directions. The first sprayer 250 may be movable in the second direction Y and the direction opposite thereto to spray a fluid. The first sprayer 250 may spray the fluid at the lower side of the suctioning portion 240.

Again referring to FIG. 1, the second sprayer 260 is adjacent to the lower surface plate 110 in the polishing space PS and is supported by the third sub-frame 213 of the support frame 210. The second sprayer 260 is supported by the third sub-frame 213 by a rail thereof extending in the second direction Y. The second sprayer 260 may be movable in the second direction Y and the direction opposite thereto to spray a fluid. The second sprayer 260 may spray the fluid at the upper side of the lower surface plate 110.

In an exemplary embodiment, the second sprayer 260 may be omitted.

Figure 5:
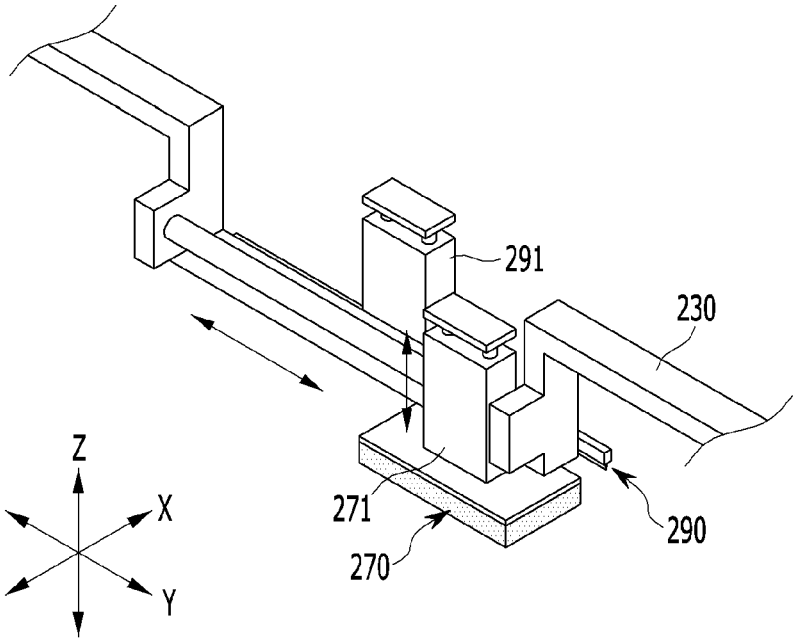
FIG. 5 is a perspective view of an exemplary embodiment of a sponge and a wiper of the substrate transporting device shown in FIG. 3.

FIG. 5 is a perspective view of an exemplary embodiment of a sponge and a wiper of the substrate transporting device shown in FIG. 3.

Referring to FIG. 5 and FIG. 3, the sponge 270 is adjacent to the suctioning portion 240 and is supported by the moving frame 230. The sponge 270 is separated from the suctioning portion 240 via the wiper 290 interposed therebetween. The sponge 270 is supported by the moving frame 230 by a rail thereof lengthwise extending in the second direction Y. The sponge 270 may be movable in the second direction Y and the direction opposite thereto, each relative to the rail of the moving frame 230. The sponge 270 further includes a sponge driver 271 which moves the sponge 270 in the third direction Z and the direction opposite thereto. The sponge 270 may be movable in the third direction Z by the sponge driver 271. That is, the sponge 270 may move in the second direction Y and the third direction Z and the directions opposite thereto.

Figure 6:
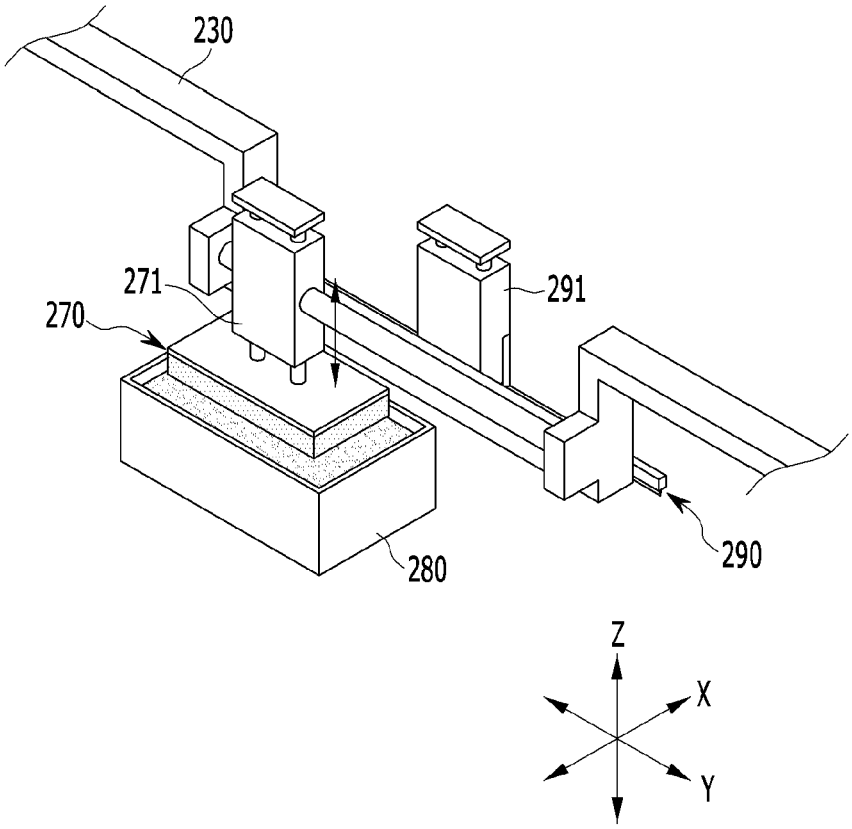
FIG. 6 is a perspective view of another exemplary embodiment of a sponge and a washing box of the substrate transporting device shown in FIG. 3.

FIG. 6 is a perspective view of an exemplary embodiment of a sponge and a washing box of the substrate transporting device shown in FIG. 3. The washing box 280 is not shown in FIG. 1 for convenience of explanation.

Referring to FIG. 6, the washing box 280 is positioned under the sponge 270. The washing box 280 may be supported by the moving frame 230 or the support frame 210. The washing box 280 may include a cleaning liquid, and the sponge 270 is moved on or into the washing box 280 in the third direction Z and/or a direction opposite thereto, and may be cleaned by the cleaning liquid of the washing box 280.

Figure 7:
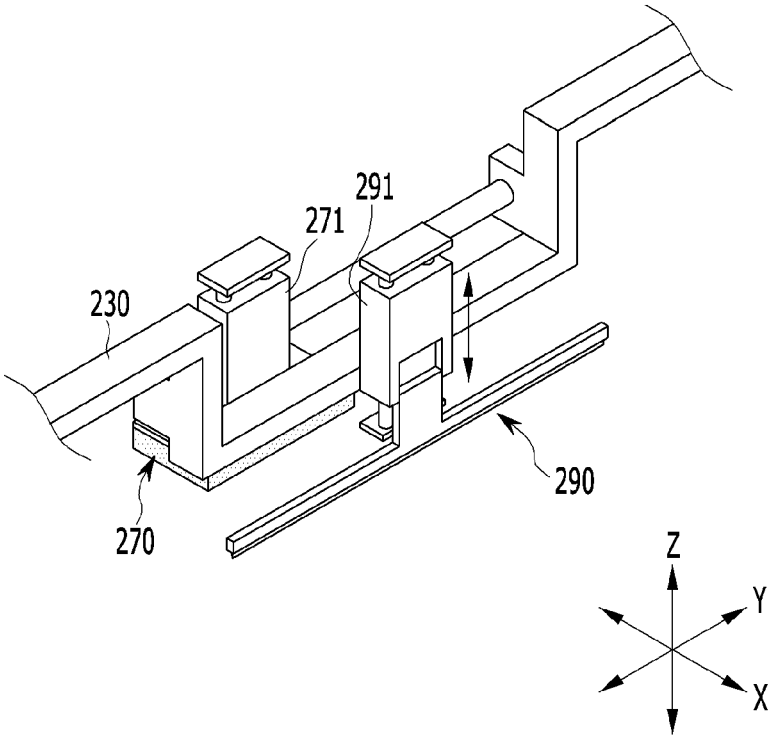
FIG. 7 is a perspective view of an exemplary embodiment of a wiper of the substrate transporting device shown in FIG. 3.

FIG. 7 is a perspective view of an exemplary embodiment of a wiper shown in FIG. 3.

Referring to FIG. 7 and FIG. 3, the wiper 290 is adjacent to the suctioning portion 240 and is supported by the moving frame 230. The wiper 290 is positioned to be closer to the suctioning portion 240 than the sponge 270 in the first direction X. The wiper 290 further includes a wiper driver 291 configured to move the wiper 290 in the third direction Z and the direction opposite thereto. The wiper 290 may move in the third direction Z and the direction opposite thereto by the wiper driver 291. That is, the wiper 290 may move in the third direction Z and the direction opposite thereto. The sponge driver 271 and the wiper driver 291 may independently move.

Again referring to FIG. 1, the conveyor 300 is separated from the polishing machine 100 and is adjacent to the substrate transporting device 200. The conveyor 300 may be positioned under the support frame 210 of the substrate transporting device 200. The conveyor 300 transports the substrate in the second direction Y and the direction opposite thereto each crossing the first direction X. The conveyor 300 may be a belt conveyor, however is not limited thereto, and as long as the conveyor 300 may transport the substrate in the second direction Y and the direction opposite thereto, the conveyor 300 may be configured of any structure.

Also, the conveyor 300 may be formed of any structure as long as the conveyor 300 may transport the substrate to be adjacent to the substrate transporting device 200.

Next, an exemplary embodiment of operation of the above-described substrate polishing system 1000 will be described with reference to FIG. 1.

The substrate including the polycrystalline silicon layer in which the protrusion is formed is transported by the conveyor 300 in the second direction Y.

The suctioning portion 240 supported by the moving frame 230 is moved by the moving unit 220 supported by the support frame 210 in the first direction X to be moved to the upper space US at the conveyor 300, and then is moved in the direction opposite to third direction Z by the moving unit 220 to suction and support the substrate having the protrusion of the polycrystalline silicon layer formed thereon. In this case, a sensor sensing whether the substrate corresponds to a plane of the upper space US at the conveyor 300 may be included in the conveyor 300.

The suctioning portion 240 supported by the moving frame 230 to support the substrate having the protrusion of the polycrystalline silicon layer formed thereon is moved in the third direction Z by the moving unit 220 supported by the support frame 210 to be separated from the conveyor 300, and then is moved by the moving unit 220 in the direction opposite to first direction X to be moved through the gate 131 and into the polishing space PS of the polishing box 130. Also, the suctioning portion 240 is moved by the moving unit 220 in the direction opposite to the third direction Z to mount the substrate to the lower surface plate 110. The substrate mounted on the lower surface plate 110 may be separated from the suctioning portion 240 and the moving frame 230.

The sponge 270 supported by the moving frame 230 separated from the substrate, is moved by the moving unit 220 in the first direction X, the second direction Y, and the third direction Z to contact the mounted substrate in each of those directions. Accordingly, the substrate is adhered to the lower surface plate 110 at the polishing space PS.

With the substrate having the protrusion of the polycrystalline silicon layer formed thereon being adhered to the lower surface plate 110, the polishing machine 100 supplies the slurry through the nozzle 140 at a position between the substrate in the polishing space PS and the upper surface plate 120. In the state that the upper surface plate 120 is in contact with the substrate having the protrusion of the polycrystalline silicon layer formed thereon to completely cover the substrate, the upper surface plate 120 and/or the lower surface plate 110 are rotated with the predetermined rotational angular velocity in the clockwise direction or the counterclockwise direction, thereby performing the chemical mechanical polishing for the protrusion of the polycrystalline silicon layer of the substrate.

In this case, the suctioning portion 240 supported by the moving frame 230 is moved in the first direction X and the third direction Z to be separated from the polishing machine 100. With the suctioning portion 240 separated from the polishing machine 100, the sponge 270 which was used to press the substrate having the protrusion of the polycrystalline silicon layer formed thereon is moved in the direction opposite to the third direction Z and is cleaned by the cleaning liquid of the washing box 280.

After the chemical mechanical polishing, the suctioning portion 240 supported by the moving frame 230 is moved by the moving unit 220 supported by the support frame 210 in the direction opposite to the first direction X and in the third direction Z, and is moved into the polishing space PS through the gate 131 of the polishing box 130 to again suction the substrate.

The first sprayer 250 supported by the moving frame 230 and the second sprayer 260 supported by the support frame 210 respectively spray a fluid from opposing sides of the substrate which has been polished, to a location between the substrate which is suctioned by the suctioning portion 240 and the lower surface plate 110 to separate the substrate from the lower surface plate 110. In an exemplary embodiment, while the first sprayer 250 and the second sprayer 260 move in the second direction Y, the fluid is sprayed between the substrate which has been polished and the lower surface plate 110.

With the polished substrate separated from the lower surface plate 110, the suctioning portion 240 is moved by the moving unit 220 in the direction opposite to the third direction Z and the direction opposite to the first direction X to hold the polished substrate thereto. The moving unit 220 with the polished substrate held thereto, moves in the third direction Z and the first direction X to transfer the polished substrate out of the polishing space PS and back to the conveyor 300. The conveyor 300 may move the polished substrate in the second direction Y to transport the polished substrate to another device which performs a subsequent process such as a substrate washing process, etc.

With the polished substrate out of the polishing space PS and back to the conveyor 300, the wiper 290 supported by the moving frame 230 is moved by the moving unit 220 in the direction opposite to the first direction X to be positioned on the lower surface plate 110. Next, while the wiper 290 is moved in the direction opposite to the first direction X, the wiper 290 is also moved in the direction opposite to the third direction Z by the moving unit 220, to contact the lower surface plate 110. By such contact, the surface of the lower surface plate 110 is cleaned by the wiper 290.

As described above, in the substrate polishing system 1000, the movement of the substrate between the conveyor 300 and the polishing machine 100 is performed by the transporting device 200, the attachment and the separation of the substrate with respect to the polishing machine 100 are performed by the same substrate transporting device 200, the chemical mechanical polishing of the substrate is performed by the polishing machine 100, and the surface cleaning of the lower surface plate 110 of the polishing machine 100 is performed by the same substrate transporting device 200. That is, the substrate transporting device 200 is commonly used in the multiple functions of transferring a substrate between the conveyor 300 and the polishing machine 100, attaching the substrate to and detaching the substrate from the polishing machine 100, and cleaning of the polishing machine 100.

As described above, the suctioning portion 240, the sponge 270, the first sprayer 250 and the wiper 290 are integrated into a single moving frame 230. In similar fashion, as described above, the support frame 210 and the single moving frame 230 are integrated into a single substrate transporting device 200. That is, according to one or more exemplary embodiments of the invention, the substrate polishing system 1000 including a single one integrated substrate transporting device 200 easily performing the multiple functions detailed above for polishing the protrusion of the polycrystalline silicon layer formed on the substrate is provided.

Next, an exemplary embodiment of a substrate polishing method according to the invention will be described with reference to FIG. 8 to FIG. 14. The substrate polishing method may be performed by one or more exemplary embodiment of the above-described substrate polishing system, however, is not limited thereto.

Figure 8:
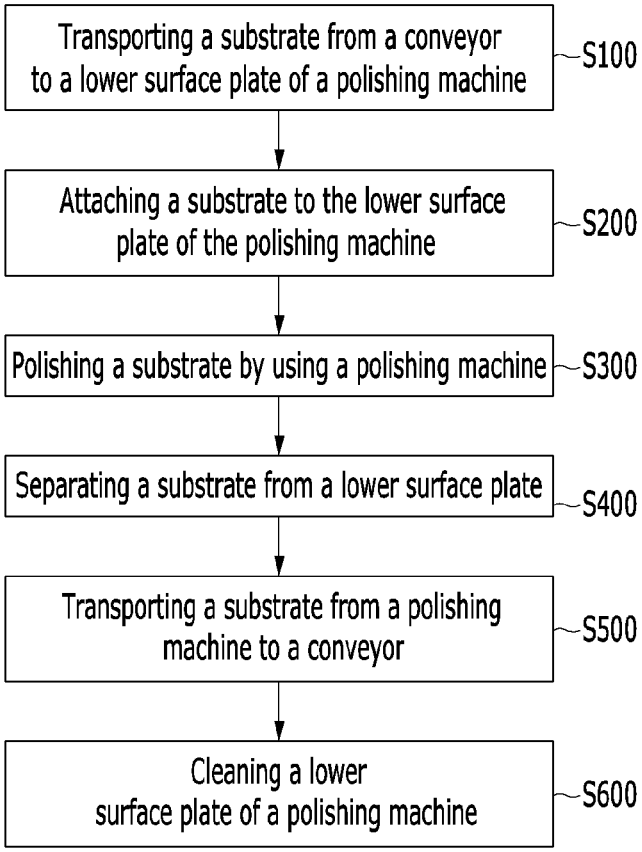
FIG. 8 is a flowchart showing an exemplary embodiment of a substrate polishing method according to the invention.

FIG. 8 is a flowchart showing an exemplary embodiment of a substrate polishing method according to the invention. FIG. 9 to FIG. 14 are cross-sectional views to explain an exemplary embodiment of a substrate polishing method using a substrate polishing system according to the invention embodiment. FIG. 9 to FIG. 14 only show configurations of the substrate polishing system related to the explanation for convenience of explanation. That is, detailed structure of constituent elements of the substrate polishing system which is illustrated in FIG. 1 to FIG. 7 is omitted for convenience of explanation. In FIG. 9 to FIG. 14, images disposed in a right to left direction generally illustrate relative positions of the polishing machine 100 and the conveyor 300 adjacent to each other in the first direction X.

Figure 9:
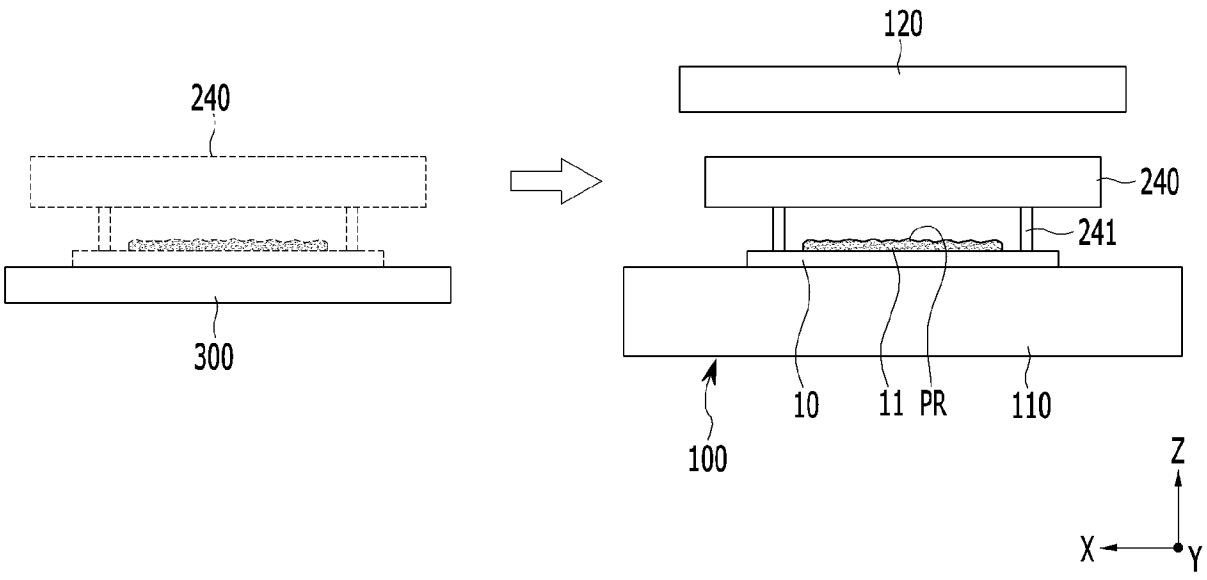
FIG. 9 to FIG. 14 are cross-sectional views to explain an exemplary embodiment of a substrate polishing method according to the invention.

First, referring to FIG. 8 and FIG. 9, a substrate 10 having a protrusion of a layer formed thereon (shown in dotted line at the conveyor 300) is transported from the conveyor 300 to the lower surface plate 110 of the polishing machine 100 (S100).

In detail, referring to FIG. 1 and FIG. 9, the substrate 10 including a polycrystalline silicon layer 11 formed with the protrusion PR (hereinafter referred to as "unpolished substrate 10") is transported in the second direction Y by the conveyor 300 to be positioned adjacent to the substrate transporting device 200. With the unpolished substrate 10 adjacent to the substrate transporting device 200, a suction force is applied to the unpolished substrate 10 such that the unpolished substrate 10 is suctioned by the suctioning portion 240 to be held thereby. With the unpolished substrate 10 held by the suctioning portion 240 of the substrate transporting device 200, the suctioning portion 240 moves in a direction opposite to the first direction X and in the third direction Z to separate the unpolished substrate 10 from the conveyor 300 and transport the unpolished substrate 10 to the lower surface plate 110 of the polishing machine 100. The suctioning portion 240 having the unpolished substrate 10 held thereby, may move in a direction opposite to the third direction Z to bring the unpolished substrate 10 into contact with the lower surface plate 110. The suctioning portion 240 may then release the unpolished substrate 10 therefrom.

Next, referring to FIG. 8, the unpolished substrate 10 is pressed to attach the substrate 10 to the lower surface plate 110 of the polishing machine 100 (S200).

Figure 10:
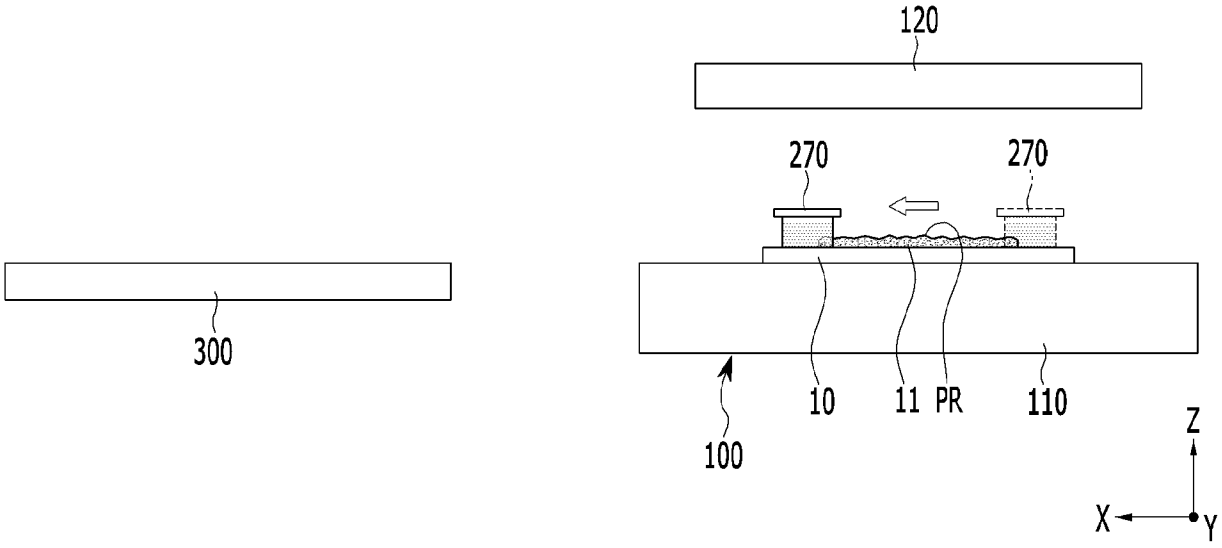

In detail, referring to FIG. 10, the substrate transporting device 200 may be moved in the first direction X, the second direction Y, and the third direction Z to dispose a rail having the sponge 270 at the unpolished substrate 10, which essentially replaces the previously-positioned suctioning portion 240 of the same substrate transporting device 200 at the unpolished substrate 10. The substrate transporting device 200 then moves in the first direction X, the second direction Y and/or the third direction Z to move the sponge 270 in corresponding directions across an entire surface of the unpolished substrate 10. In FIG. 10, the sponge 270 movement in the first direction X is shown as an example. By the sponge 270 being moved in the corresponding directions, the entire surface of the unpolished substrate 10 mounted to the lower surface plate 110 is pressed toward the lower surface plate 110 to attach the unpolished substrate 10 to the lower surface plate 110.

Figure 11:
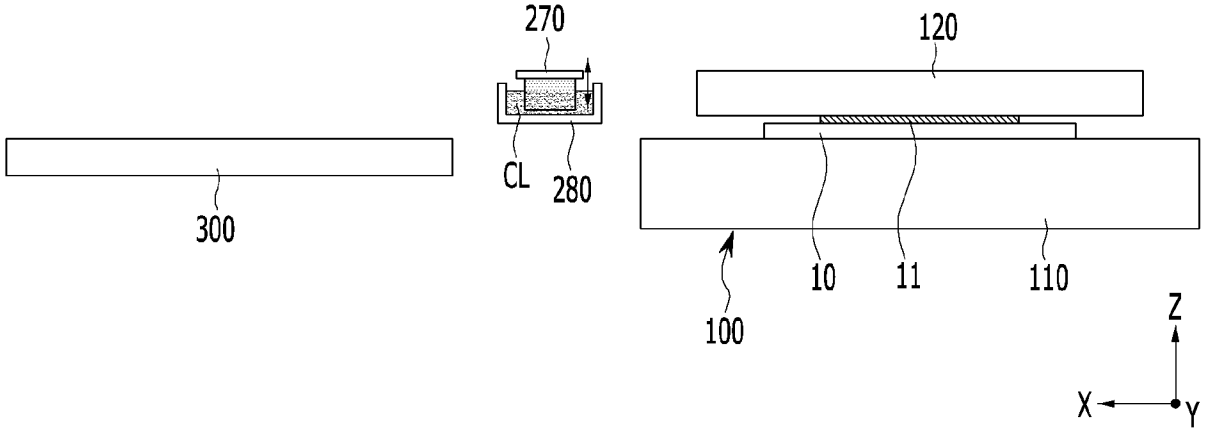

Next, referring to FIG. 11, the unpolished substrate 10 is polished by using the polishing machine 100 (S300).

In detail, the slurry is supplied between the unpolished substrate 10 and the upper surface plate 120. With the upper surface plate 120 in contact with the unpolished substrate 10 to completely cover the unpolished substrate 10, the upper surface plate 120 and the lower surface plate 110 are rotated in the clockwise direction or the counterclockwise direction with the predetermined rotational angular velocity to chemically and mechanically polish the protrusion of the polycrystalline silicon layer 11 on the substrate 10.

During polishing of the substrate 10, the substrate transporting device 200 may be disposed non-overlapping with the polishing machine 100. Referring to FIG. 11, the sponge 270 previously-positioned at the unpolished substrate 10 (FIG. 10) is moved in the first direction X to be disposed outside the polishing machine 100. Although not shown, with reference to FIGS. 1 and 3, the suctioning portion 240 and the first sprayer 250 attached to the same moving frame 230 of the substrate transporting device 200 as the sponge 270, are disposed adjacent to the sponge 270 in the first direction X. With the substrate transporting device 200 disposed non-overlapping with the polishing machine 100, the sponge 270 is cleaned by the cleaning liquid CL of the washing box 280.

Next, referring to FIG. 8, with the substrate 10 being polished (hereinafter referred to as "polished substrate 10") a fluid is sprayed between the polished substrate 10 and the lower surface plate 110 to separate the polished substrate 10 from the lower surface plate 110 (S400).

Figure 12:
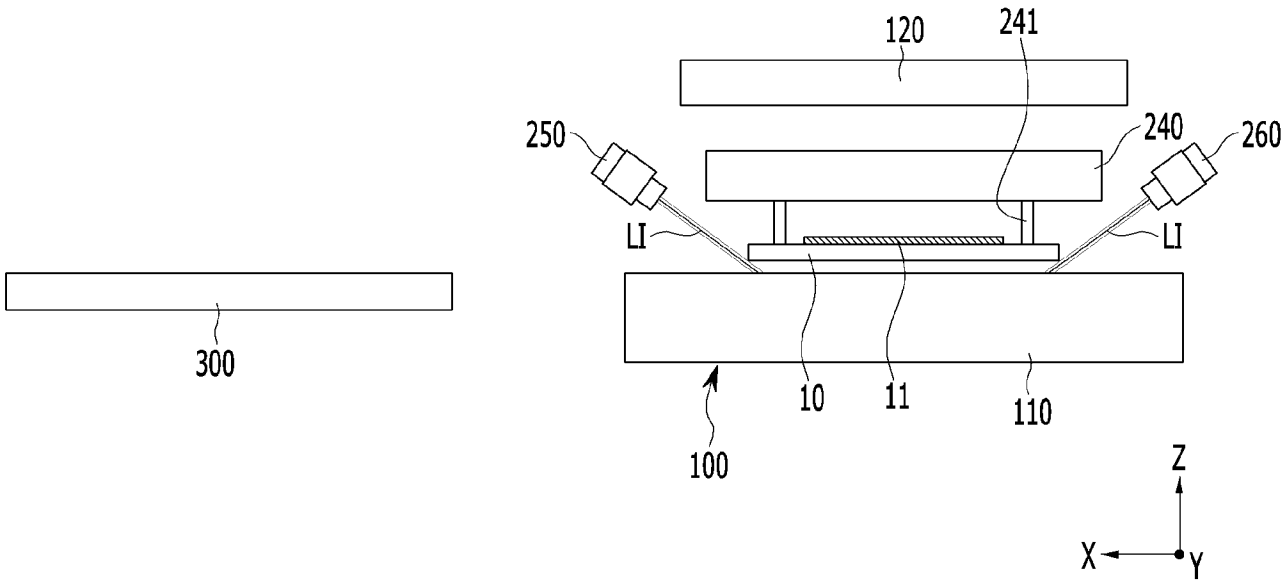

In detail, referring to FIG. 12, from being disposed non-overlapping with the polishing machine 100, the substrate transporting device 200 moves the suctioning portion 240 in the direction opposite to the first direction X and in direction opposite to the third direction Z to apply a suction force to the polished substrate 10 attached to the lower surface plate 110. With the suctioning portion 240 disposed at the polished substrate 10, the first sprayer 250 on the same moving frame 230 as suctioning portion 240 is positioned at a side of the polished substrate 10 opposite to a side in the first direction X at which the second sprayer 260 of the substrate transporting device 200 is disposed.

Before or at the same time as the polished substrate 10 being held by the suctioning portion 240, the fluid LI is sprayed from both of the opposing sides and toward a boundary or interface between the polished substrate 10 and the lower surface plate 110 by respectively using the first sprayer 250 and the second sprayer 260, thereby reducing an attachment of the polished substrate 10 and the lower surface plate 110 to separate the polished substrate 10 from the lower surface plate 110. In an exemplary embodiment, while the first sprayer 250 and the second sprayer 260 are moved in the second direction Y and/or a direction opposite thereto, the fluid LI is sprayed at the interface between the substrate and the lower surface plate 110.

Next, referring to FIG. 8, the polished substrate 10 is transported from the polishing machine 100 to the conveyor 300 (S500).

Figure 13:
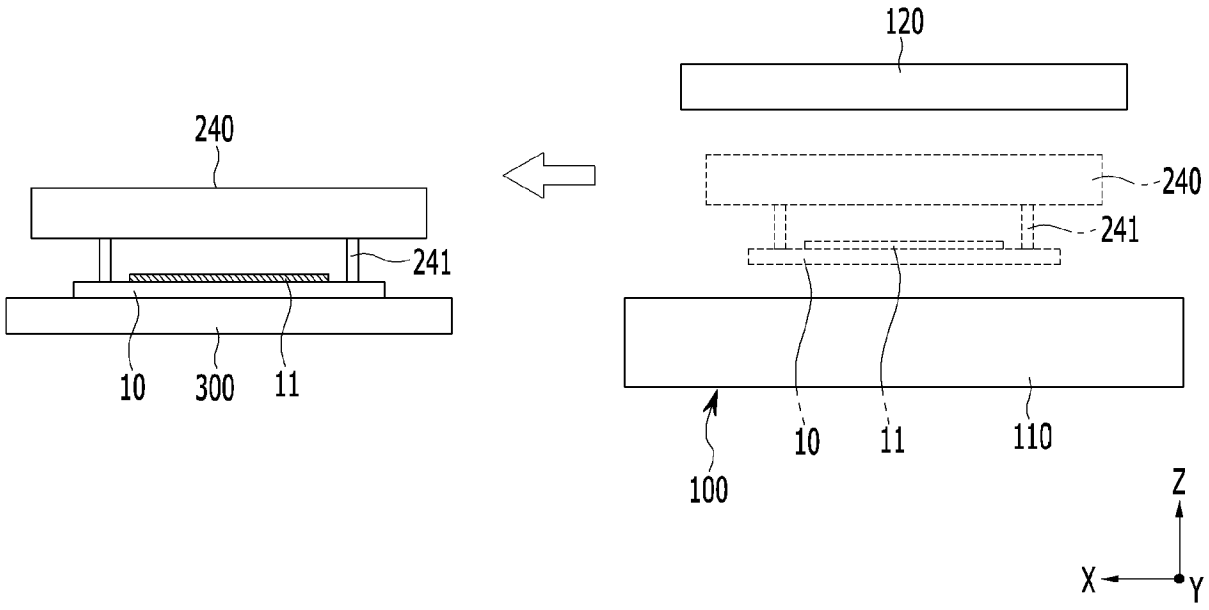

In detail, referring to FIG. 13, the suctioning portion 240 to which the polished substrate 10 is suctioned in FIG. 12 (shown as dotted line in FIG. 13) is moved in the third direction Z and the first direction X to transport the polished substrate 10 from the polishing machine 100 to the conveyor 300. The suctioning portion 240 having the polished substrate 10 held thereby, may move in a direction opposite to the third direction Z to bring the polished substrate 10 into contact with the conveyor 300. The suctioning portion 240 may then release the polished substrate 10 therefrom, to be freely disposed on the conveyor 300.

The polished substrate 10 that is freely disposed on the conveyor 300, may be transported by the conveyor 300 in the second direction Y (refer again to FIG. 1) and away from the polishing machine 100 and substrate transporting device 200 to perform subsequent operations on the polished substrate 10 such as a substrate washing process, etc.

Referring to FIG. 13, with the suctioning portion 240 disposed at the conveyor 300 to release the polished substrate 10 thereto, the moving frame 230 to which the suctioning portion 240 is attached may dispose at least the sponge 270 and the wiper 290 outside the polishing machine 100.

Next, referring to FIG. 8, the lower surface plate 110 of the polishing machine 100 is cleaned (S600).

Figure 14:
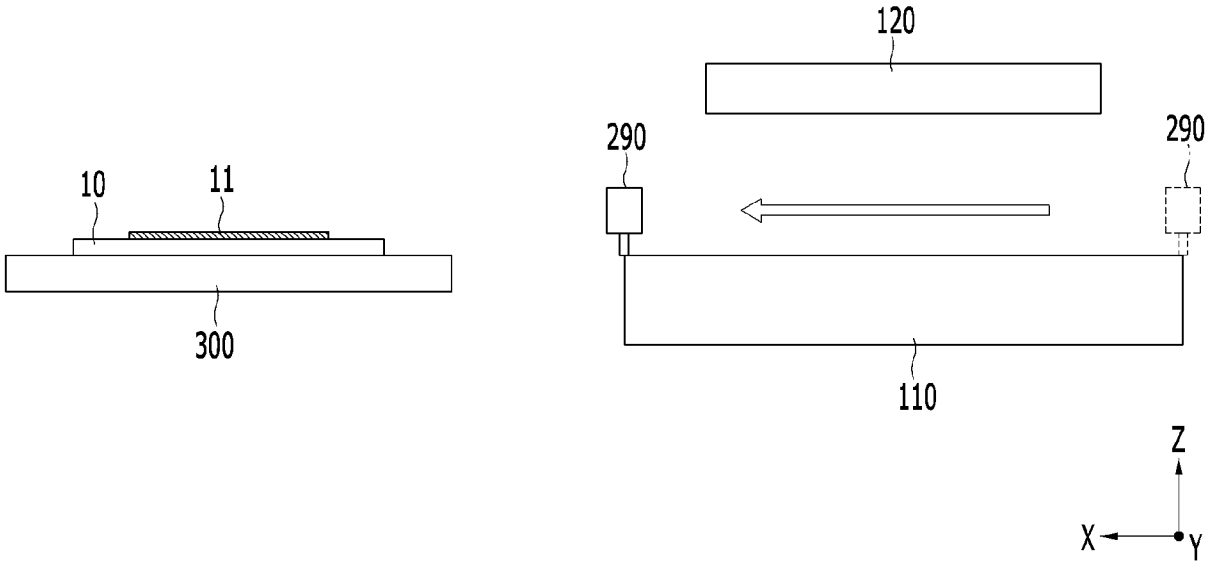

In detail, referring to FIG. 14, the substrate transporting device 200 moves the wiper 290 from outside the polishing machine 100 to the lower surface plate 110. The surface of the lower surface plate 110 on which the substrate 100 is mounted is cleaned by moving the wiper 290 in the first direction X and the third direction Z, or in directions opposite thereto, across the surface of the lower surface plate 110.

As above-described, the substrate polishing method using a same substrate transporting device 200 at which the suctioning portion 240, the sponge 270, the first and second sprayers 250 and 260, and the wiper 290 are disposed, easily polishing the protrusion PR of the polycrystalline silicon layer 11 formed on the substrate 10 is provided.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A substrate polishing system comprising:

a polishing machine comprising:

a lower surface plate to which a substrate is mounted, and an upper surface plate which faces the lower surface plate and polishes the substrate in cooperation with the lower surface plate, the upper surface plate having a larger area than the substrate mounted on the lower surface plate;

a substrate transporter which is movable independent from the upper surface plate and commonly transports the substrate to and from the polishing machine in a first direction, attaches the substrate to the lower surface plate, separates the substrate from the lower surface plate; and a conveyor which is adjacent to the polishing machine in the first direction and transports the substrate to and from the substrate transporter in a second direction crossing the first direction, wherein the substrate transporter includes:

a substrate holder which both fixes the substrate to the substrate transporter and releases the substrate from the substrate transporter, and a support frame including:

a first sub-frame including a first guide rail extending in the first direction from the conveyor to the polishing machine to overlap both the conveyor and the polishing machine, and a second sub-frame separated from the first sub-frame in the second direction and including a second guide rail extending in the first direction from the conveyor to the polishing machine to overlap both the conveyor and the polishing machine, and attachment of the substrate to the lower surface plate by the substrate transporter includes disposing the substrate holder detached from both the substrate and the upper surface plate.

2. The substrate polishing system of claim 1, wherein the substrate transporter extends in the first direction to overlap both the conveyor and the polishing machine.

3. The substrate polishing system of claim 2, wherein the polishing machine further includes:

a polishing box which forms a polishing space in which the lower surface plate is positioned;

a nozzle which supplies slurry to the polishing space; and a slurry tank connected to the nozzle.

4. The substrate polishing system of claim 1, wherein the substrate transporter further includes:

a moving frame which is connected to each of the first sub-frame and the second sub-frame of the support frame, movable between the conveyor and the polishing box in the first direction, and movable relative to the polishing space in a third direction crossing the first and second directions;

a moving connector which connects the moving frame to the first sub-frame and the second sub-frame of the support frame, the moving connector being movable in the first direction along the first guide rail and the second guide rail of the support frame, and movable in the third direction relative to the first guide rail and the second guide rail of the support frame; and the substrate holder which is connected to the moving frame and movable in the first direction, the second direction and the third direction by movement of the moving frame.

5. The substrate polishing system of claim 4, wherein the moving connector includes:

a first portion which is movable along the support frame in the first direction; and a second portion which is connected to the first portion and movable relative to the support frame in the third direction.

6. The substrate polishing system of claim 4, wherein the substrate transporter further commonly sprays a fluid and includes:

a first sprayer which is connected to the moving frame to which the substrate holder is connected and movable together with the substrate holder by movement of the moving frame, the first sprayer being adjacent to the substrate holder and movable in the second direction relative to the moving frame; and a second sprayer which is connected to the support frame and disposed adjacent to the lower surface plate in the polishing space, is movable in the second direction relative to the support frame and through which the fluid is sprayable.

7. The substrate polishing system of claim 6, wherein the support frame includes a third sub-frame extending in the second direction to cross the polishing space, and the second sprayer is connected to the third sub-frame and movable in the second direction relative to the third sub-frame.

8. The substrate polishing system of claim 4, wherein the substrate transporter further includes:

a sponge which is connected to the moving frame to which the substrate holder is connected and movable together with the substrate holder by movement of the moving frame, the sponge being adjacent to the substrate holder and movable in the second direction and the third direction relative to the moving frame; and a washing box positioned under the sponge.

9. The substrate polishing system of claim 4, wherein the substrate transporter further includes a wiper which is connected to the moving frame to which the substrate holder is connected and movable together with the substrate holder by movement of the moving frame, the wiper being adjacent to the substrate holder and movable in the third direction relative to the moving frame.

10. The substrate polishing system of claim 1, wherein polishing of the substrate by the upper surface plate in cooperation with the lower surface plate, includes disposing the substrate holder detached from both the substrate and the upper surface plate.

* * * * *